US010512804B2

(12) United States Patent
Klarlund et al.

(10) Patent No.: US 10,512,804 B2
(45) Date of Patent: Dec. 24, 2019

(54) FLUID DELIVERY SYSTEM AND METHOD OF USE

(71) Applicants: Jacques Klarlund, Gorlose (DK); Lola Klarlund-Younger, Gardnerville, NV (US)

(72) Inventors: Jacques Klarlund, Gorlose (DK); Lola Klarlund-Younger, Gardnerville, NV (US)

( * ) Notice: Subject to any disclaimer, the term of this patent is extended or adjusted under 35 U.S.C. 154(b) by 36 days.

(21) Appl. No.: 14/830,563

(22) Filed: Aug. 19, 2015

(65) Prior Publication Data

US 2016/0051848 A1 Feb. 25, 2016

Related U.S. Application Data

(60) Provisional application No. 62/039,127, filed on Aug. 19, 2014.

(51) Int. Cl.

| | |
|---|---|
| ***A62C 3/02*** | (2006.01) |
| ***A62C 31/24*** | (2006.01) |
| ***A62C 99/00*** | (2010.01) |

(52) U.S. Cl.

CPC ..... *A62C 3/0271* (2013.01); *A62C 3/0292* (2013.01); *A62C 31/24* (2013.01); *A62C 99/0072* (2013.01)

(58) Field of Classification Search

CPC ..... A62C 3/0271; A62C 3/0292; A62C 31/05; A62C 31/24; A62C 35/60; A62C 35/605; A62C 37/10–16; A62C 99/0072; A62C 3/0214; A62C 37/00; A62C 37/36; A62C 37/38; A62C 37/40; A62C 31/02; A62C 31/005; A62C 31/28; A62C 35/11–15; B05B 12/02; B05B 12/04; B05B 12/12; B05B 13/0278; B05B 15/62–15/628

USPC ..... 169/46, 51, 56–61, 70; 239/551

See application file for complete search history.

(56) References Cited

U.S. PATENT DOCUMENTS

| | | | | |
|---|---|---|---|---|
| 3,576,212 A * | 4/1971 | Siler | ..... | A62C 3/0292 169/16 |
| 5,211,336 A * | 5/1993 | Kaidonis | ..... | A62C 3/0292 169/43 |
| 8,534,370 B1 * | 9/2013 | Al Azemi | ..... | A62C 31/24 169/15 |
| 2004/0163827 A1 * | 8/2004 | Privalov | ..... | A62C 3/0271 169/46 |

(Continued)

FOREIGN PATENT DOCUMENTS

| | | | | |
|---|---|---|---|---|
| FR | 2344302 A1 * | 10/1977 | ..... | A62C 3/0271 |
| GB | 1472732 A * | 5/1977 | ..... | A62C 29/00 |

*Primary Examiner* — Cody J Lieuwen

(74) *Attorney, Agent, or Firm* — Holland & Hart LLP

(57) ABSTRACT

Systems and methods of dispensing fluids such as fire suppressant include a fire suppressant delivery system having at least one fire suppressant delivery apparatus. The fire suppressant delivery apparatus includes a tower member, at least one dispensing mechanism mounted to the tower member and operable to adjust at least one of a dispensing angle relative to a horizontal plane and a dispensing angle circumferentially about the tower member, at least one fire monitoring device mounted to the tower member and operable to detect fire, and a flow regulator automatically operable to control flow of a fire suppressant to the at least one dispensing mechanism in response to fire detected by the at least one fire monitoring device.

14 Claims, 10 Drawing Sheets

(56) References Cited

U.S. PATENT DOCUMENTS

| | | | | |
|---|---|---|---|---|
| 2010/0163256 | A1* | 7/2010 | Williams | A62C 31/03 169/46 |
| 2010/0236799 | A1* | 9/2010 | Vetesnik | A62C 5/02 169/70 |
| 2013/0062080 | A1* | 3/2013 | Tobin | A62C 31/28 169/46 |
| 2013/0168110 | A1* | 7/2013 | Baribbi | A62C 31/24 169/25 |
| 2015/0129245 | A1* | 5/2015 | Weber | A62C 3/0271 169/46 |

* cited by examiner

FLUID DELIVERY SYSTEM AND METHOD OF USE

CROSS-REFERENCE TO RELATED APPLICATIONS

The present application claims priority through the applicant's prior provisional patent application, entitled LIQUID DELIVERY SYSTEM AND METHOD OF USE, application Ser. No. 62/039,127, filed 19 Aug. 2015, which provisional application is hereby incorporated by reference in its entirety.

FIELD OF TECHNOLOGY

The present disclosure is directed to fluid delivering systems and related methods of delivering fluids, such as fire suppressants.

BACKGROUND

The process of firefighting is centuries old. The principal of firefighting is to eliminate contact with oxygen at the source of fire. This is achieved by placing fire suppressant, such as water or sand, directly onto the fire.

Fire engines have long been used to deliver fire suppressant onto fires. Fire engines typically includes a vehicle frame and at least one fire extinguishing mechanism, such as a hose attached with a nozzle, disposed on or within the vehicle for dispensing a fire suppressant onto a fire. Fire engine may or may not be equipped with a tank which stores fire suppressant. One common method to secure consistent supply of fire suppressant, such as water, is to rely on fire hydrants. This application requires specially trained firefighters to drive the fire engine to the location of the fire, to control the water hose, raise and lowering the hose nozzle for directing a flow of fire suppressant onto the fire, etc. Although fire engines are commonly used, fire engines are somewhat limited in usefulness in rural areas because of the limited access to fire suppressant and the vehicle's inability to enter difficult terrain.

Other applications have been in use for many years to fight fire in rural area. These applications include the use of, for example, aircraft to deliver fire suppressant from above the fire, and the use of a remote controlled robots to detect the location of the fire and dispense fire suppressant onto the fire. Aircraft may provide advantages in areas that are difficult to access by ground vehicles. Dispensing fire suppressant directly from above the fire usually provides the an efficient and effective way to stop fire traveling across the top of the foliage. However, aircraft require highly trained pilots to accurately dispense fire suppressant on top of the fire. Further, flying aircraft through smoke and fire conditions puts the pilot and other personal on the aircraft in danger. In case of a fire breakout in large areas, multiple aircraft are required to effectively dispense enough fire suppressant to stop the fire because an aircraft has limited capacity to store fire suppressant. Using multiple aircraft to fight large area of fire in a rural area may be expensive and impractical.

Remote controlled robots may provide advantages related to reduced human interaction with the fire. The robot may include a camera, remote control capability, and other features that provide a remote operator the ability to identify and fight the fire. Robots typically are not suitable for fighting fire that covers large area of rural land because of their limited capacity for storing and delivering fire suppressant. Similar to a traditional fire engine, a remote controlled robot also cannot access difficult terrain where many fires exist.

BRIEF SUMMARY OF SOME ASPECTS OF THE DISCLOSURE

The present disclosure is directed to fluids (e.g., fire suppressant) delivery systems and methods of dispensing fluids. An example system and method in accordance with the present disclosure provides for delivery of a large amount of fire suppressant to an area (e.g., to a wild fire that covers large rural area). In a further aspect, water or other type of fire suppressant are dispensed to multiple areas at once. The fire suppressant may be dispensed at a height that is at or above the foliage or other flammable materials in the area of the fire. The dispensed fire suppressant may limit the spread of fire or may put out at least portions of the fire. The systems and methods disclosed herein may provide remote control of the delivery and dispensing of fire suppressant to a targeted location in a way that limits human exposure to the fire.

Another aspect of the present disclosure relates to monitoring fire conditions and/or an area in proximity to a fire and automatically dispensing fire suppressant based on the monitoring. A further aspect relates to a system operator observing the situation of the fire through a video feed located in an area of the fire and activating the fire suppressant delivery system remotely to dispense fire suppressant when the operator detects presence of fire. In some instances, the camera may be mounted to a device used to dispense the fire suppressant.

An example dispensing system provide dispensing of fire suppressant radially outward from a dispensing tower around selective portions of a circumference of the tower. The dispensing system may also dispensing the fire suppressant at an angle relative to a horizontal plane. The spraying angle may be optimized for efficiency.

The dispensing system may include an adjustable height tower, or at least an adjustable height for the fire suppressant dispensing features (e.g., nozzles, sprinkler heads, or the like). The system provide an adjustable spraying pressure. The pressure, volume flow, dispensing opening, and other features may be adjusted manually or automatically to dispense the fire suppressant in a way that optimizes suppression and/or prevention of the fire and/or spreading of the fire.

In some implementations, the dispensing system includes components, such as a dispensing tower, that comprise fire retardant material to sustain extreme heat conditions. Components of the dispensing system may be coated with a fire retardant material to match the surrounding environment for aesthetic purposes.

In one aspect, the delivery system includes a plurality of dispensing members that are individually controlled to provide for more directed fire suppressant delivery. The dispensing member may be activated to dispense fire suppressant based on, for example, a detected location of the fire. In a further aspect, each dispensing member has at least one dispensing feature (e.g., a spray angle relative to a horizontal plane) that is controlled to adjust delivery of fire suppressant.

It is to be understood that this Brief Summary recites some aspects of the present disclosure, but there are other novel and advantageous aspects. They will become apparent as this specification proceeds.

It is also to be understood that aspects of the present disclosure may not necessarily address one or all of the issues noted in the Background above. The scope of the present invention is thus to be determined by the claims as issued and not whether they address issues noted on the Background or provide features recited in this Brief Summary.

BRIEF DESCRIPTION OF THE DRAWINGS

The applicant's preferred and other embodiments are further disclosed in association with the accompanying drawings, in which.

Figure 1:
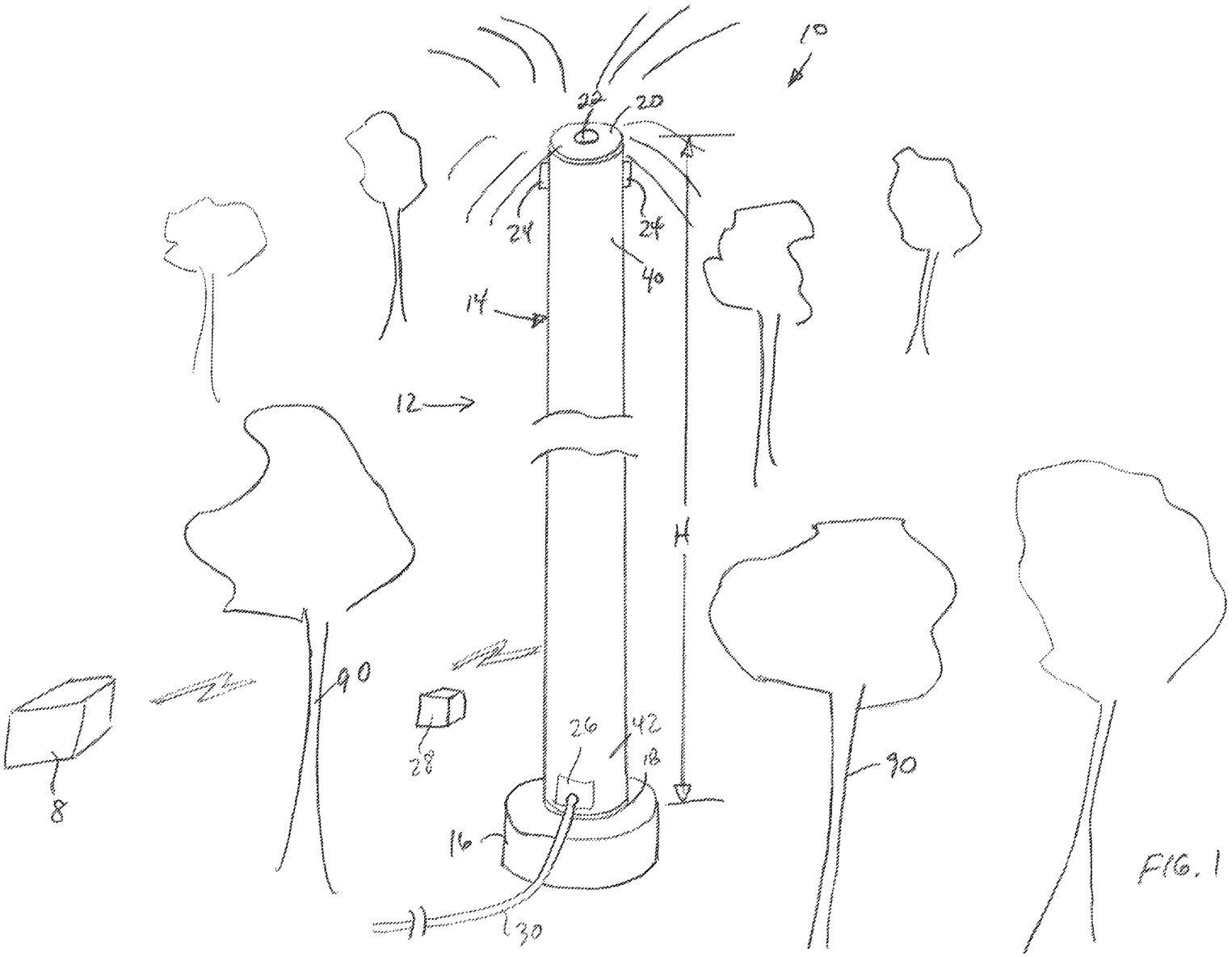
FIG. 1 is a perspective view of a fire suppressant delivery system in a forest environment in accordance with the present disclosure.

It is to be understood that specially-orienting terms, such as top, bottom, front, back, upwardly, or downwardly are used to explain relative orientation of structures as shown in the figures and as the structure might be used. They are not to be constructed, however, to require such an orientation in space.

Throughout the drawings, identical reference characters and descriptions indicate similar, but not necessarily identical, elements. While the embodiments described herein are susceptible to various modifications and alternative forms, specific embodiments have been shown by way of example in the drawings and will be described herein. However, one of ordinary skill in the art will understand that the embodiment described herein are not intended to be limited to the particular forms disclosed. Rather, the instant disclosure covers all modifications, equivalents, and alternatives falling within the scope of the appended claims.

DETAILED DESCRIPTION OF THE PREFERRED AND OTHER EMBODIMENTS

The present disclosure is directed to fluid delivery systems, and particularly fluid delivery systems for use in delivering fire suppressants. Other aspects of the present disclosure are directed to methods of delivering fluids such as fire suppressants. The systems and methods disclosed herein may be directed particularly to delivery of fluids for suppressing fires and/or for limiting and/or preventing the spread of fires.

One aspect of the present disclosure relates to a fluid delivery system that includes one or more dispensing mechanisms. The dispensing mechanisms may dispense fluid to specific areas and/or in specific directions. The ability to control the angle of dispensing and/or the direction of dispensing along with other characteristics of dispensing (e.g., droplet size, pressure, duration, height and the like) may assist in efficiently applying the fire suppressant or other fluids to specific areas. Dispensing to specific areas may be particularly useful for when fighting fires and/or preparing structures and/or foliage for the arrival of fires. The systems and methods disclosed herein may also include monitoring and/or detecting fire conditions and then controlling dispensing of the fluid based on the monitoring.

The systems and methods disclosed herein may also relate to a system of fluid dispensing apparatuses, wherein the system includes a plurality of dispensing apparatuses positioned at various locations within an area. The dispensing apparatuses may be controlled individually as well as in cooperation with each other to efficiently dispense fluid in particular areas. The dispensing of fluids by the plurality of delivery apparatuses may be controlled based on monitored conditions of the fire. The system may dispense fluids automatically based on certain monitored criteria. Alternatively, the dispensing may occur based controls provided from a remote position by one or more operators.

The delivery apparatuses may be individually moveable via, for example, motorized carts or other mobility features to better optimize delivery of the fluid to a specific area. The fluid used for dispensing may be drawn from a source of fluid, such as a body of water (e.g., a pond or lake), a fire hydrant, a tanker truck, a fire engine, or other storage vessel. The fluid being dispensed may be in the form of liquids, gels, foams, gases, or any combination thereof.

Referring now to FIGS. 1-5, an example fire suppressant delivery system 10 is shown and described. The fire suppressant delivery system 10 includes a delivery apparatus 12, as shown in at least FIGS. 1 and 5. The delivery apparatus 12 includes a tower 14, a base 16, a mounting plate 18, a cap 20, a dispensing mechanism 22, at least one monitoring device, 24, a regulator, 26, a control system, 28, and a delivery hose 30.

The tower 14 may have an upper end 40 and a lower end 42. The tower 14 is mounted at the lower end 42 to base 16. Base 16 may be permanently mounted to a support surface such as a ground surface. In some embodiments, base 16 includes a cavity, recess or the like to house other features of the delivery apparatus 12 such as control system 28 or portions of the regulator 26. In one embodiment, base 16 comprises steel-reinforced concrete at least partially buried in the ground.

Figures 2, 3, 4:
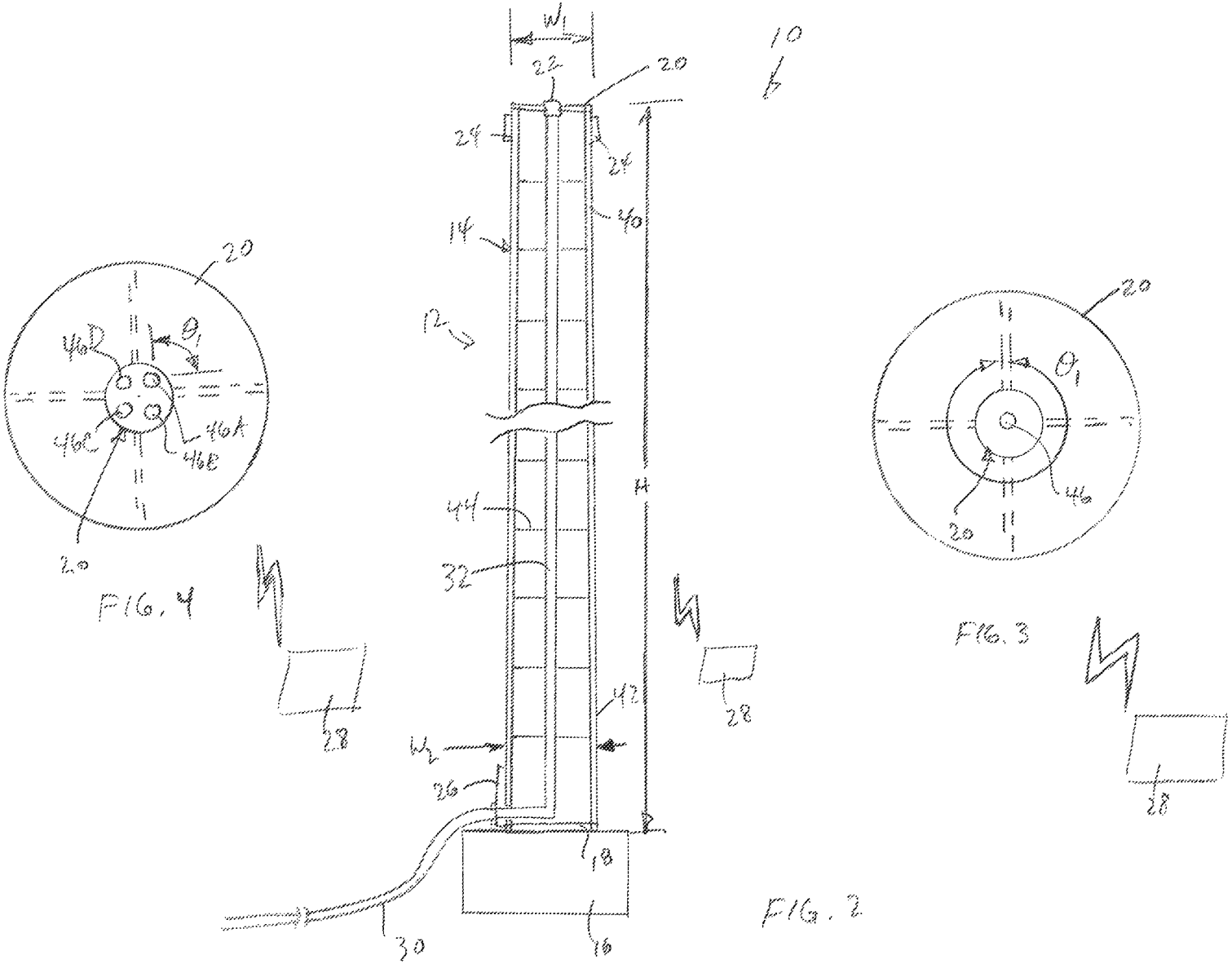
FIG. 2 is a cross-sectional view of the fire suppressant delivery system of FIG. 1.
FIG. 3 is a top views of the fire suppressant delivery system of FIG. 1.
FIG. 4 is a top views of another embodiment of fire suppressant delivery system of FIG. 1.
Figure 5:
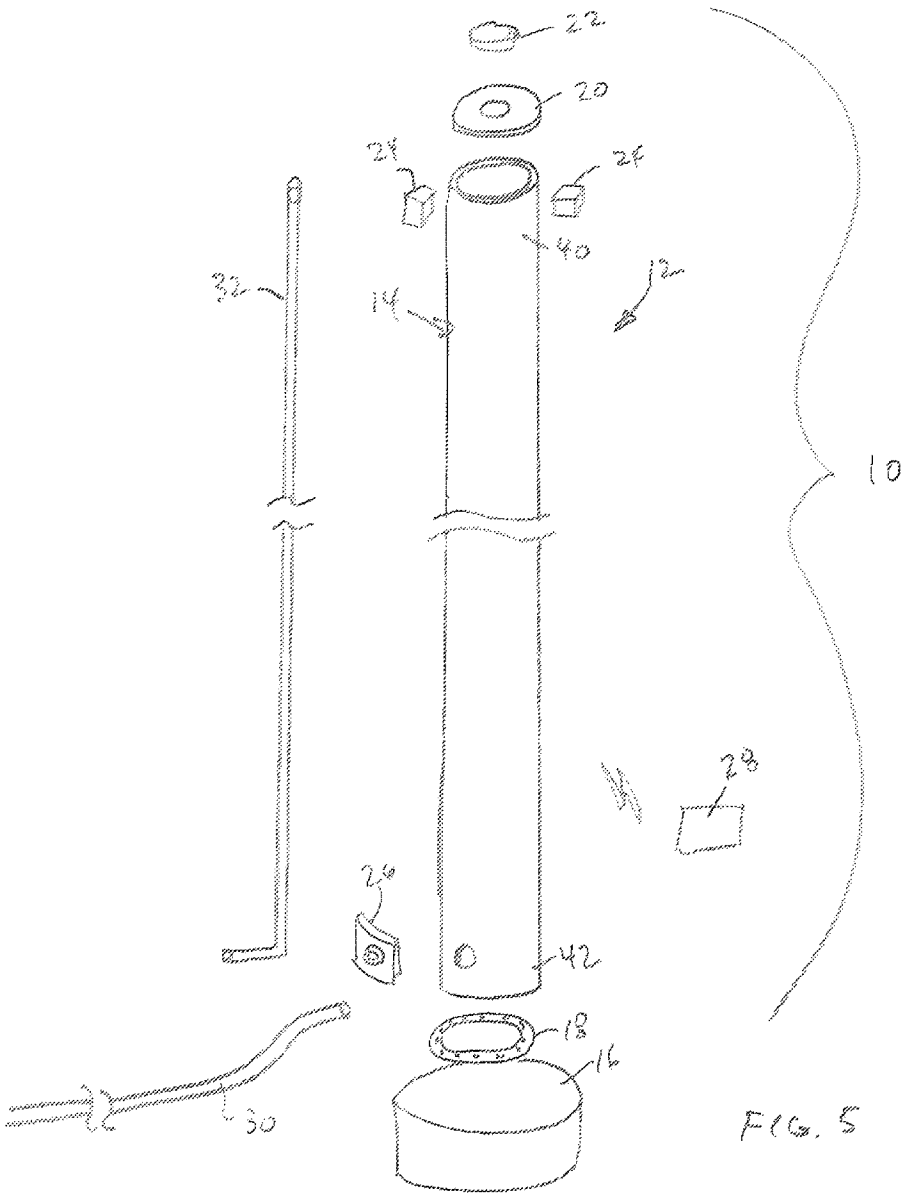
FIG. 5 is an exploded perspective view of the fire suppressant delivery system of FIG. 1.

Referring to FIG. 2, the tower 14 may include a plurality of inner supports 44 that support a dispensing pipe 32. The dispensing pipe 32 extends internally from the regulator 26 to the cap 20. The tower 14 may have a height H, an upper end width $W_1$, and a lower end width $W_2$. The tower 14 is mounted to the base 16 directly or via the mounting plate 18. The cap 20 is mounted to the tower 14 at the upper end 40. The cap 20 may support dispensing mechanism 22. The dispensing pipe 32 may be coupled in fluid communication with the dispensing mechanism 22.

The tower 14 may have a variable width between the lower end 42 and the upper end 40. For example, the width $W_1$ may be less than the width $W_2$. The width of the tower 14 may taper gradually from the lower end 42 to the upper end 40. In some arrangements, the tower 14 comprises a cylindrical structure with a circular cross-sectional shape. In other embodiments, the tower 14 may have other shapes including, for example, a rectangular cross-sectional shape, a constant width between the upper and lower ends, 40 and 42, or a solid, rather than hollow construction. The hollow structure of the tower 14 shown in at least FIG. 2 accommodates the dispensing pipe 32 internally. This design may provide protection for dispensing pipe 32 from environmental conditions such as intense heat from a fire.

The tower 14 may have a fixed height H. Typically the height H is at or above the maximum height of building structures and/or foliage in an area surrounding the delivery apparatus 12. Referring to FIG. 1, the tower 14 has a height H that places the dispensing mechanism 22 above the plurality of trees 90 surrounding the delivery apparatus 12. As such, when the delivery apparatus 12 dispenses a volume of fluid (e.g., fire suppressant), the fluid falls on top of the adjacent positioned foliage and/or building structures. The fluid is then able to provide improved resistance to traveling of a fire across the top of the foliage and/or buildings, which may otherwise occur, particularly in high wind conditions. Further, the delivered fluid at or above the level of the adjacent foliage and/or building structures provides for a maximum dispensing distance for the fluid relative to the delivery apparatus 12. By maximizing the distance of dispensing, each individual delivery apparatus 12 may be able to provide maximum coverage for purposes of suppressing fires and/or preventing the spreading of fire.

Figure 6:
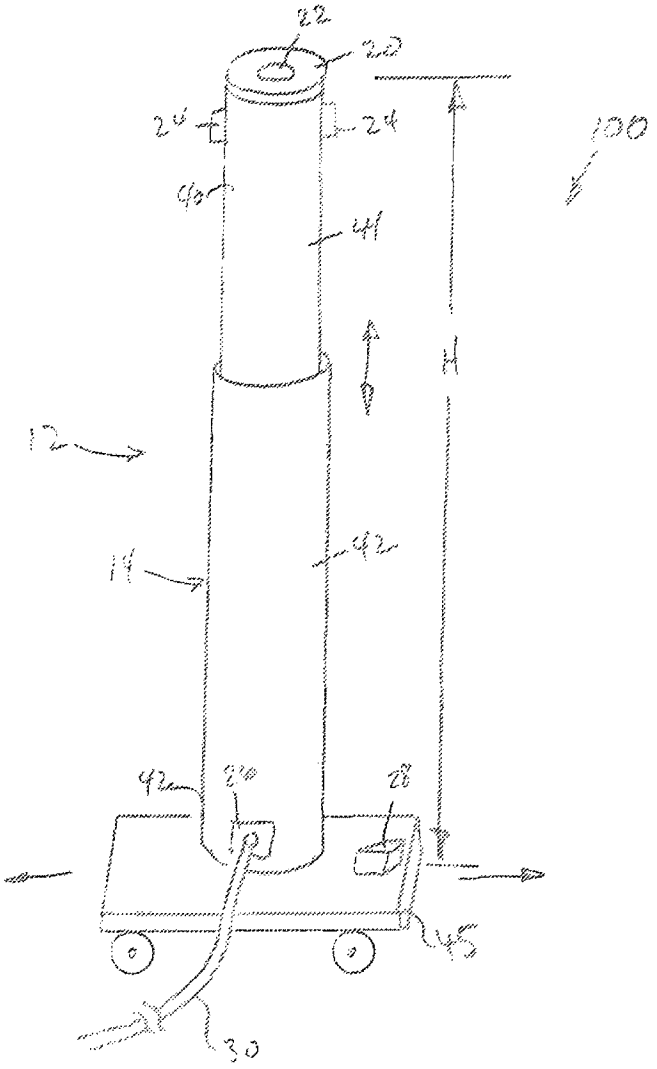
FIG. 6 is a perspective view of another embodiment of a fire suppressant delivery system in accordance with the present disclosure.

The tower 14 may have height adjustment capability to assist in positioning the dispensing mechanism 22 at or above the height of adjacent foliage and/or building structures. FIG. 6 illustrates another example fire suppressant delivery system 100 that includes a tower 14 having upper and lower portions 41, 43. The upper and lower portions 41, 43 are moveable axially relative to each other. By adjusting the relative axial position of the upper and lower portions 41, 43, the height H of tower 14 may be adjusted as desired. The height H of tower 14 may typically be in the range of about 6 feet to about 100 feet, and more preferably in the range of about 20 feet to about 50 feet. In some embodiments, the tower 14 of fire suppressant delivery system 100 may have more than two portions to provide additional telescoping to increase a range of heights H possible between fully retracted and fully extended positions.

FIGS. 3 and 4 illustrate separate embodiments for dispensing mechanism 22. FIG. 3 shows dispensing mechanism 22 having a single nozzle 46. The nozzle 46 may dispense fluid in a radial direction circumferentially around tower 14 through an angle $\Theta_1$. In some embodiments, the nozzle 46 may be controlled to vary the angle $\Theta_1$ depending on, for example, which portion of an area surrounding the delivery apparatus 12 is intended to be covered with the dispensed fluid. The angle $\Theta_1$ is typically in the range of about 0° to about 360°. In other embodiments, the nozzle 46 may have a fixed dispensing angle $\Theta_1$ that is anywhere between 0° and 360°. The control system 28 may control the dispensing mechanism 22 and/or nozzle 46 to control the dispense angle $\Theta_1$.

FIG. 4 shows another embodiment for dispensing mechanism 22 that includes a plurality of nozzles 46A-D. Each of the nozzles 46A-D may dispense fluid in a circumferential angle $\Theta_1$ of about 0° to about 360°, and more preferably in the range of about 0° to about 90°. In one embodiment, each nozzle 46 A-D has a dispense angle $\Theta_1$ of about 90°. Each of the nozzles 46 A-D may be individually controlled between on and off states to provide dispensing in individual quadrants around the circumference of tower 14. For example, nozzles 46 A and 46 B may be turned on to provide dispensing of about 180° of the circumference of the delivery apparatus 12, while nozzles 46C and 46D are turned off. Other combinations of on and off states are possible for nozzles 46A-B, such as the combination of 46A and 46C being on, while 46B and 46D are off; 46C being on while nozzles 46A, 46B and 46D are off; or any other combination thereof.

In other embodiments, different numbers of nozzles 46 may be provided on any given dispensing mechanism 22. The number of nozzles may vary between, for example, 1 nozzle and 100 nozzles, and more preferably in the range of 1 nozzle to 10 nozzles.

Referring again to FIG. 2, a single dispensing pipe 32 may be used to feed all of the nozzles of a given dispensing mechanism 22. The dispensing mechanism 22 may distribute the fluid delivered through dispensing pipe 32 evenly to each of the nozzles 46. In some embodiments, dispensing mechanism 22 may be controlled via control system 28 to vary the volume, pressure, or other characteristic of the fluid flow to the nozzles 46 individually. In other embodiments, a separate dispensing pipe 32 is provided for each nozzle 46 of the dispensing mechanism 22.

Figure 7:
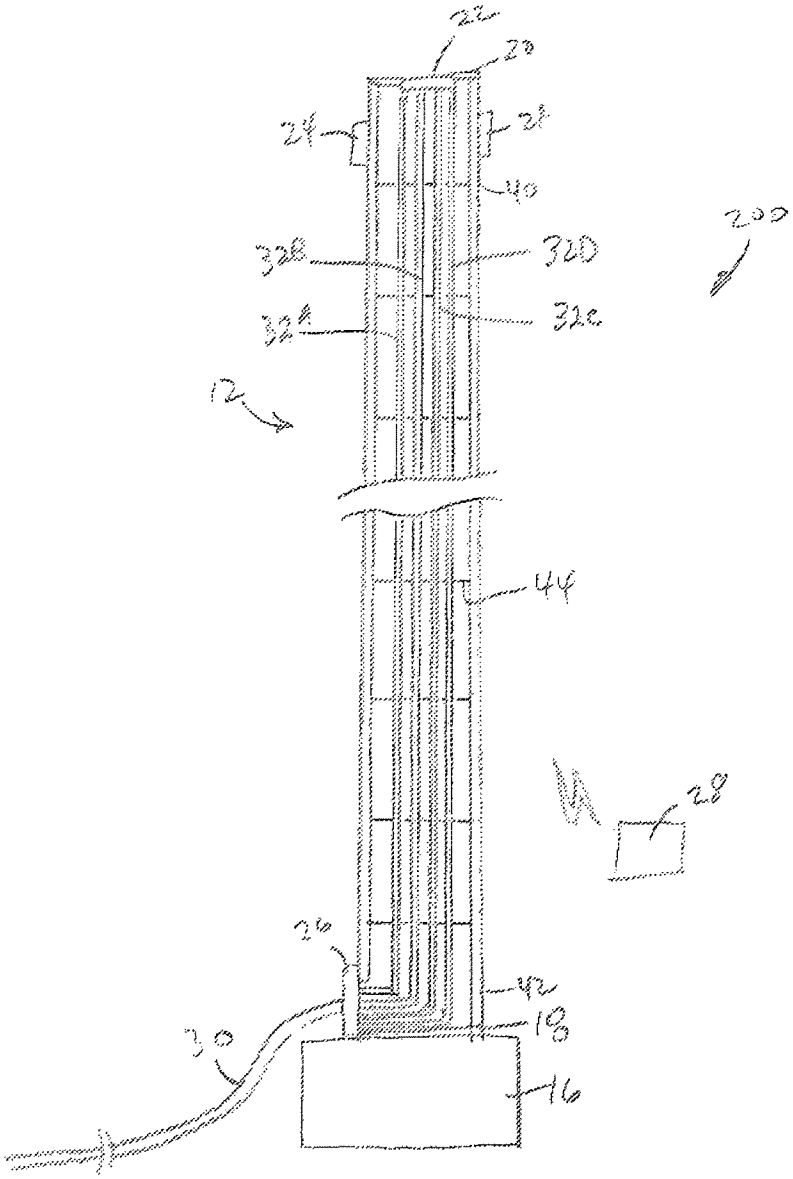
FIG. 7 is a cross-sectional view of another embodiment of a fire suppressant dispensing mechanism in accordance with the present disclosure.

Referring to FIG. 7, a fire suppressant delivery system 200 includes a plurality of dispensing pipes 32A-D. Each of the dispensing pipe 32 A-D may be coupled in flow communication with a separate one of the nozzles 46 of the dispensing mechanism 22 (e.g., nozzles 46A-D shown in FIG. 4). In other arrangements, any one of the individual dispensing pipes 32A-D may be coupled in flow communication to more than one nozzle. Alternatively, a plurality of dispensing pipes 32A-D may be coupled to a single nozzle 46 or to any combination of the nozzles of the dispensing mechanism 22.

The dispensing pipe 32 may be a rigid pipe that is supported internal the tower by supports 44 and has a fixed length. In other embodiments, the dispensing pipe 32 comprises a flexible hose or other flexible construction. The flexible hose may be particularly useful for embodiments of the delivery apparatus having height adjustability capabilities, wherein extra length of the hose is able to collect within the tower 14 to account for changes in height.

The regulator 26 may be controlled, for example, by control system 28, to regulate the flow of fluid from delivery hose 30 to the dispensing pipe 32. The regulator 26 may also provide a coupling structure for connecting the delivery hose 30 to the dispensing pipe 32. The regulator 26 may control such parameters as pressure, volume flow, and on/off state for flow of fluid to any one of the dispensing pipes 32. The regulator 26 is shown mounted to the tower 14. In other embodiments, regulator 26 may be mounted to the base 16 or other structure of the delivery apparatus 12. The regulator 26 may comprise a T-connector or other connector that couples the dispensing pipe 32 to the delivery hose 30. Furthermore, the dispensing pipe 32 may extend along an exterior of tower 14 rather than an interior of tower 14.

The dispensing mechanism 22 is shown mounted to the cap 20 at the upper end 40 of tower 14. In other embodiments, the dispensing mechanism 22 may be positioned along the length of the tower 14 between the upper and lower ends, 40, 42. In one example, the dispensing mechanism 22 includes a plurality of nozzles 46, and the nozzles 46 are positioned at various locations along the length of the tower 14 between the upper and lower ends 40, 42. The nozzles at various locations along the length of tower 14 may be individually controlled to provide dispensing of fluid at various heights and/or at various locations around the perimeter of the tower 14 to dispense fluid at specific areas adjacent to the delivery apparatus 12.

The monitoring devices 24 shown in the figures may include any of a variety of different monitoring equipment. For example, the monitoring device 24 may include a video camera, a still shot camera, an infrared camera, a motion sensor, a smoke sensor, a fire sensor, or any other sensor or monitoring device that may be useful in the context of dispensing fluids and/or monitoring fire or smoke conditions. The monitoring device 24 may include other types of sensors such as, for example, barometric pressure sensors, humidity sensors, temperature sensors, and the like.

Monitoring device 24 is shown positioned at the upper end 40 of tower 14, which may be particularly useful if the monitoring device 24 includes a camera. Positioning the camera at the greatest height H possible may provide an improved view of the area surrounding the delivery apparatus 12. In other embodiments, the monitoring device may be positioned at other locations along the length of tower 14 between the upper and lower ends 40, 42. The monitoring devices 24 may include some types of monitoring devices and/or sensors at one location along the length of tower 14 while including different types of devices and/or sensors at other locations.

Data generated by the monitoring device 24 may be transmitted to control system 28. Control system 28 may evaluate the information provided by the monitoring devices and provide automated control of the delivery apparatus 12 in response thereto. The automated control of delivery apparatus 12 may be based on real-time detection and/or monitoring of fire conditions. The control of delivery apparatus 12 may be conducted essentially in real-time based on fire conditions detected by, for example, monitoring device 24. In some examples, the control system 28 may transmit the information from monitoring devices 24 to a remote location such as, for example, a remotely located central control center 8 (see FIG. 1). Control system 28 may include a transmitter and/or receiver. In at least some embodiments, the control system 28 may be mounted directly to the mobile device 45 as opposed to other mounted locations (e.g., on tower 14 and/or base 16). In some embodiments, the monitoring devices 24 may each include a transmitter and/or receiver to communicate data directly to other locations (e.g., central control center 8), equipment, or systems (e.g., dispensing mechanism 22 and/or regulator 26) in addition to or in place of communicating with control system 28.

In one scenario, the monitoring devices 24 detect a fire condition in a certain direction within a certain distance of the delivery apparatus 12. The monitoring device 24 via, for example, the control system 28, may automatically control the dispensing mechanism 22 to dispense fluid (e.g., fire suppressant) for a certain amount of time and in the specified direction. The pressure of fluid delivery may be altered to dispense the fluid a desired distance and/or at a certain droplet size to provide the desired type of fluid dispensing. A droplet size may be controlled at least in part by an opening size of one or more nozzles, a pressure condition for the delivered fluid, and/or a volume flow rate for the fluid. In some embodiments, the fluid may be delivered with a droplet size that provides a mist and/or fog of the fluid. In other embodiments, the fluid is dispensed with a larger droplet size, such as would be common when the nozzle has a sprinkler-type construction. The size of the droplets may influence how far the fluid is dispensed. In the scenario of a fog type dispensing of the fluid, the fog may travel great distances depending on wind and other environmental conditions. A fog or mist may be able to travel into otherwise difficult places for the fluid to reach.

The delivery hose 30 may be connected in flow communication with any desired source of fluid. For example, the hose 30 may be connected to a pump that draws water from a lake, river or pond. The hose 30 may be connected to a fire hydrant, fire truck, or other storage vessel. The delivery hose 30 may be flexible or rigid. In some embodiments, the delivery hose 30 may have fire retardant properties. The delivery apparatus 12 may be mounted to a mobile device 45, such as the cart structure shown in FIG. 6. The mobile device 45 may include its own power source to provide mobility of the mobile device 45 to move the delivery apparatus 12 to a desired location. The movement of mobile device 45 may occur automatically based on the information collected by monitoring device 24. Alternatively, the mobile device 45 may be controlled from a remote location to change a position of the delivery apparatus 12. The delivery hose 30 may be flexible to permit movement of the mobile device 45 without affecting the flow of fluid through hose 30 to the regulator 26.

Figure 8:
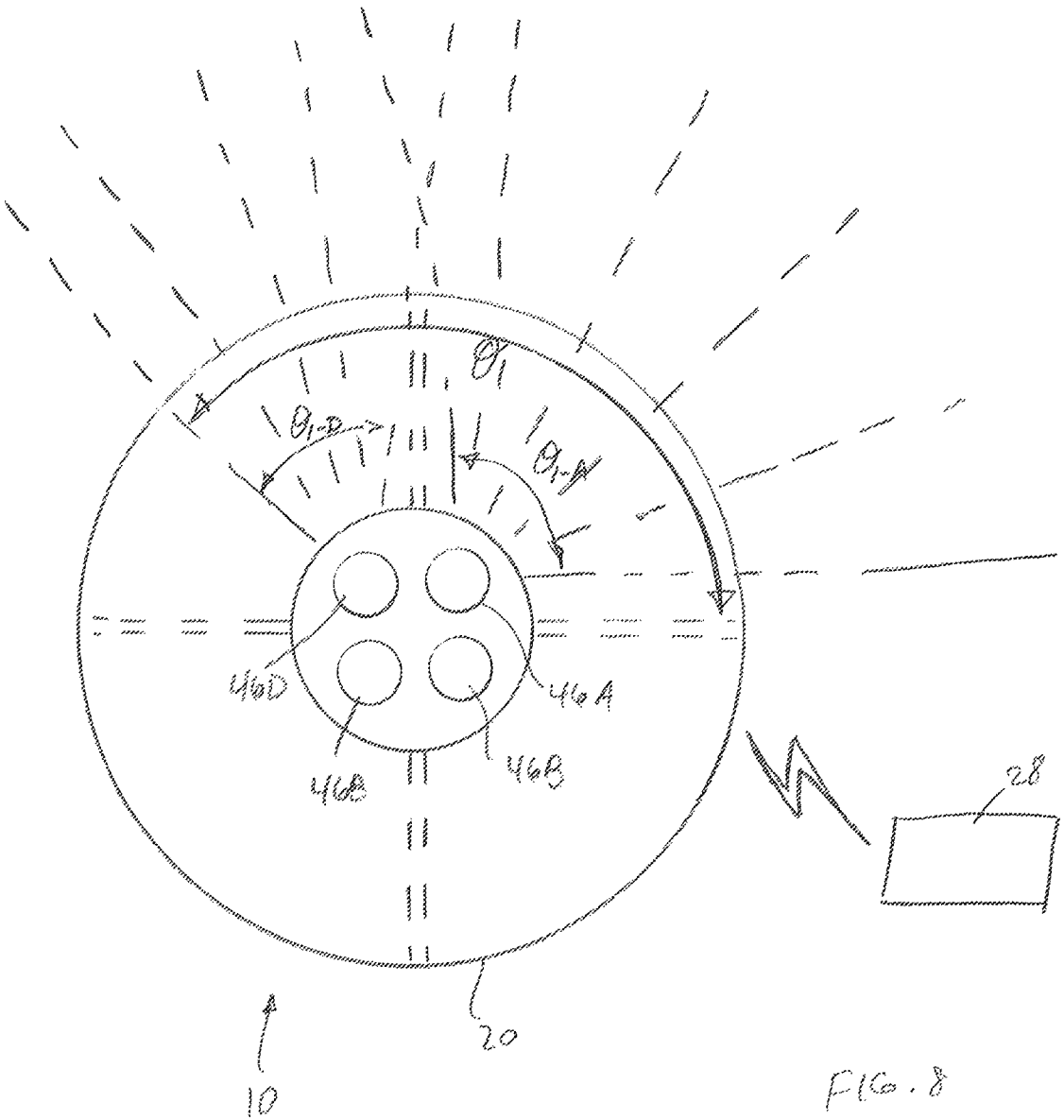
FIG. 8 is a top view of a dispensing mechanism according to one mode of operation.
Figure 9:
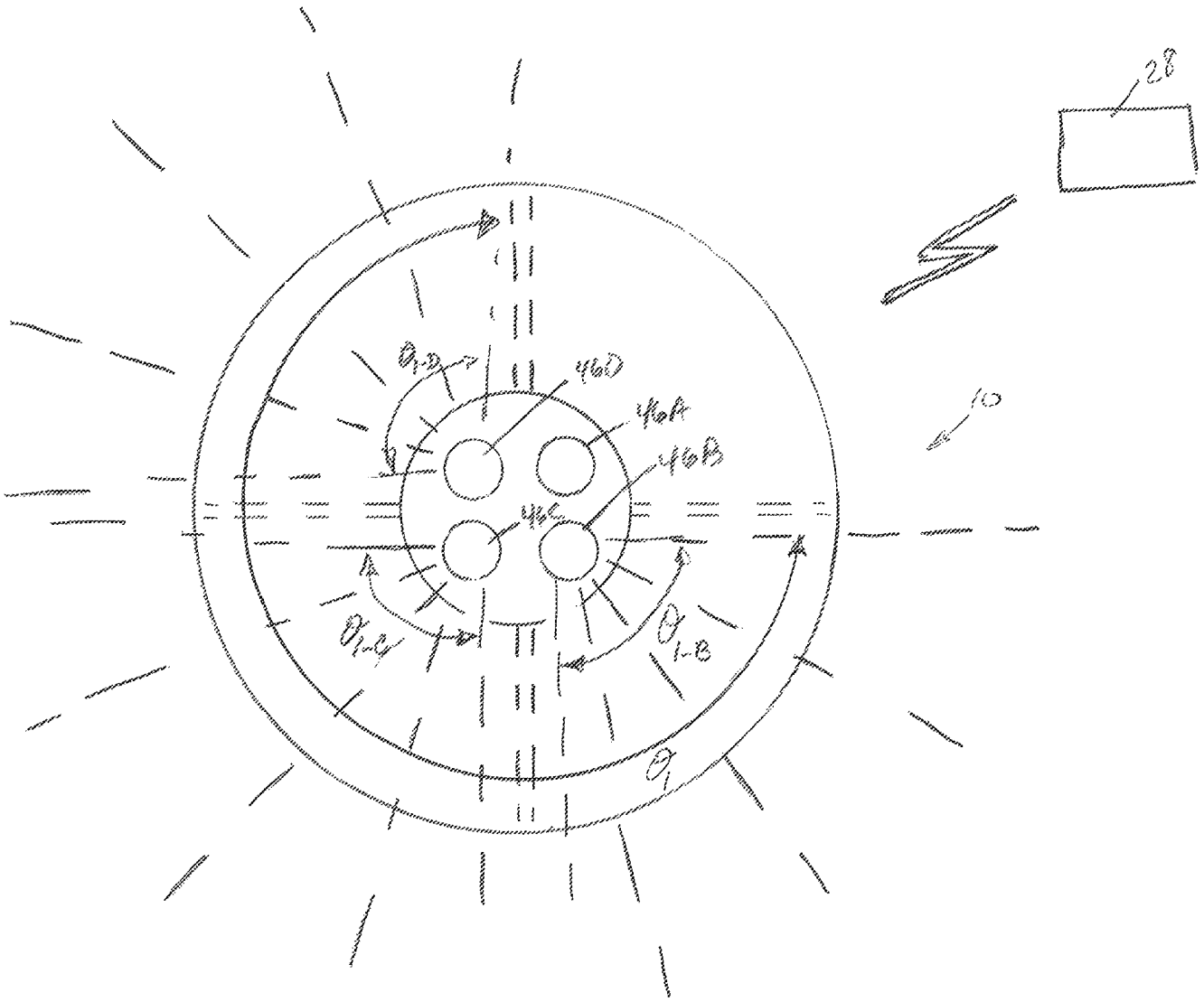
FIG. 9 is a top view of a dispensing mechanism according to another mode of operation.

FIGS. 8 and 9 show several dispensing arrangements for dispensing mechanism 22 having a plurality of nozzles 46A-D. FIG. 8 shows nozzle 46A operating to dispense through an angle $\Theta_{1\text{-}A}$ of about 90° and nozzle 46D dispensing through a dispense angle $\Theta_{1\text{-}D}$ of less than 90° (e.g., about 45°). The total dispense angle $\Theta_1$ of about 135°. FIG. 9 shows an arrangement in which each of nozzles 46B-D are dispensing through angles of about 90° for a total dispensing angle $\Theta_1$ of about 270°. As discussed above, any one of the nozzles 46A-D may be individually controlled to have a dispense angle of less than 90° or between about 90° and about 360°. The operation of nozzles 46A-D may be controlled via control system 28.

Figure 10:
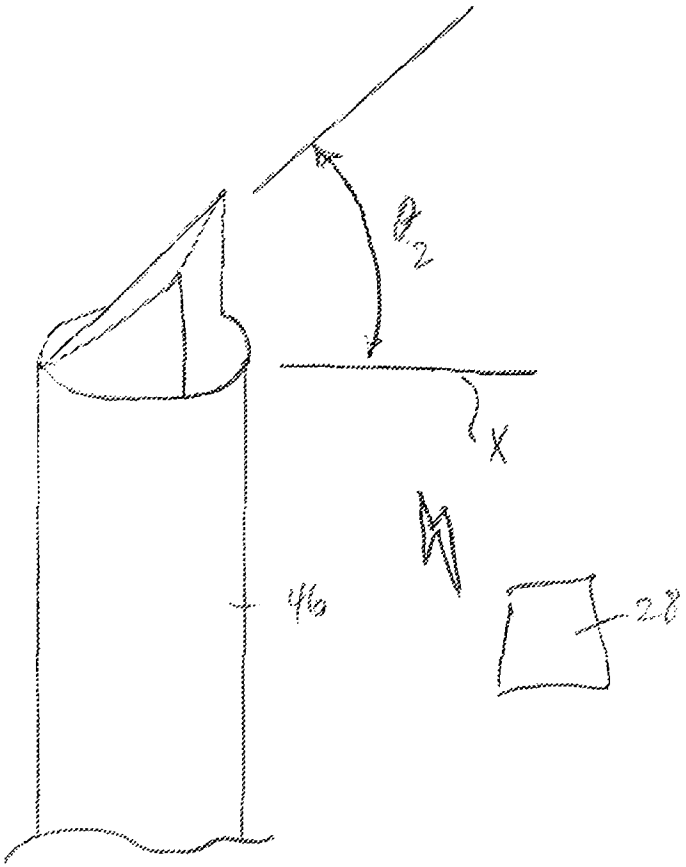
FIG. 10 is a side view of an example dispensing nozzle in accordance with the present disclosure.
Figure 11:
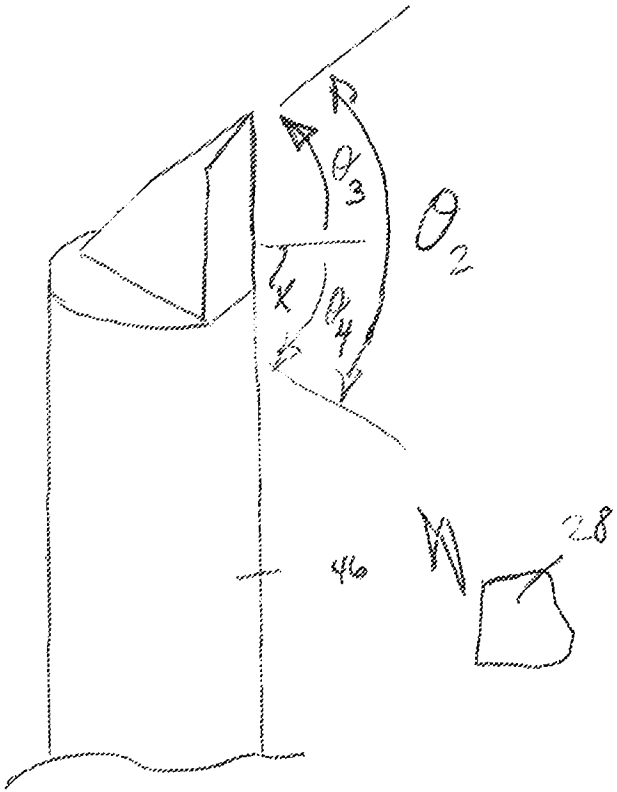
FIG. 11 is a side view of another example dispensing nozzle in accordance with the present disclosure.

FIGS. 10 and 11 illustrate nozzles 46 having different dispense angles $\Theta_2$ relative to a horizontal plane. FIG. 10 shows nozzle 46 having a dispense angle $\Theta_2$ measured vertically upward from the horizontal plane X. The angle $\Theta_2$ shown in FIG. 10 is about 45° to about 60°. The angle $\Theta_2$ may be in the range of about 0° to about 90°, although in some embodiments the angle $\Theta_2$ may be between about 0° and about 180°. FIG. 11 shows a separate nozzle embodiment 46 having a dispense angle $\Theta_2$ that overlaps the horizontal plane X. Angle $\Theta_2$ includes an angle component $\Theta_3$ that is vertically above the plane X and an angle component $\Theta_4$ that is vertically below the horizontal plane X. The angle $\Theta_2$ shown in FIG. 11 is about 90°. The angle $\Theta_2$ shown in FIG. 11 is typically in the range from about 0° to about 270°, and more particularly in the range from about 45° to about 180°.

The angle $\Theta_2$ shown in FIGS. 10 and 11 may be controlled via, for example, control system 28. The angle $\Theta_2$ may be varied depending on, for example, a desired distance for dispensing the fluid, and/or a target area to be covered with the dispensed fluid. In other embodiments, the nozzles 46 are interchanged with other nozzles having different fixed dispensing angles $\Theta_2$ or a range of angles $\Theta_2$ to provide specified dispensing properties for the delivery apparatus 12 that meet certain conditions where the delivered apparatus is in use.

Figure 13:
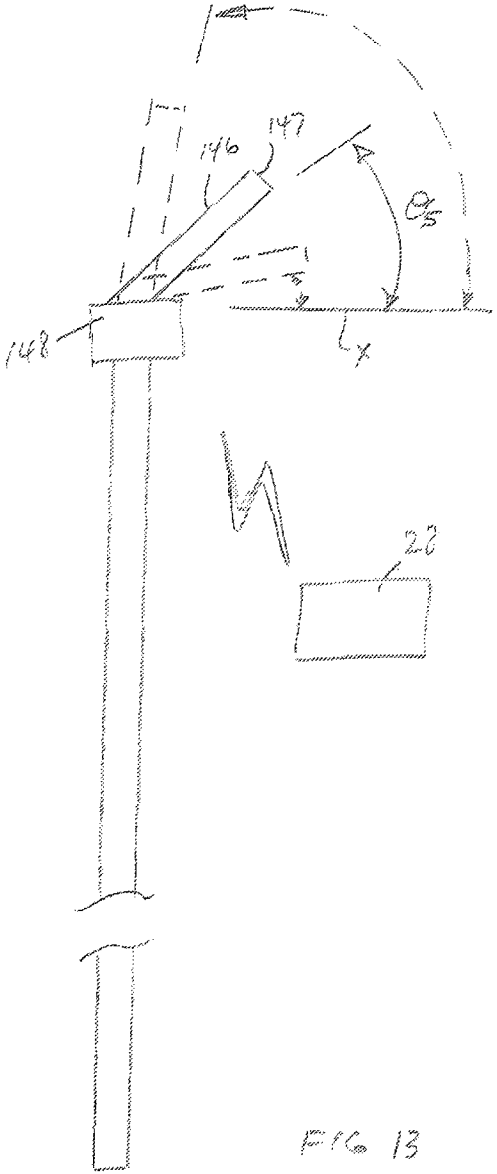
FIG. 13 is a side view of another example dispensing nozzle in accordance with the present disclosure.
Figure 12:
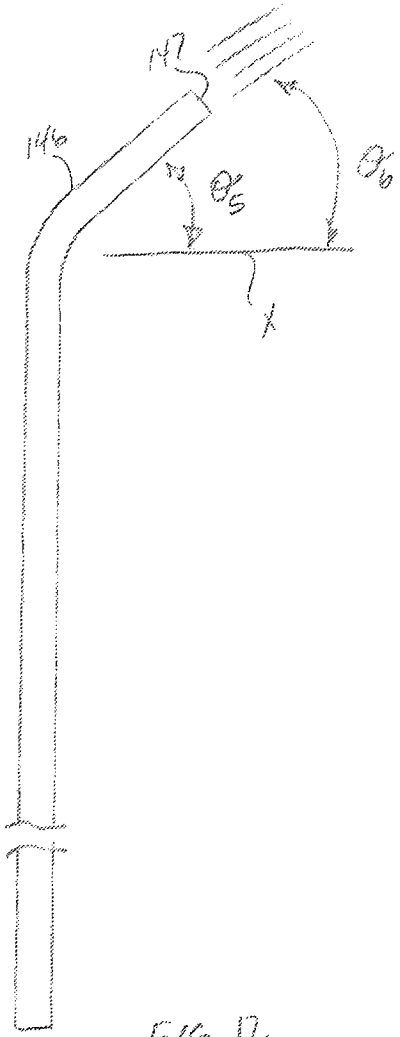
FIG. 12 is a side view of another example dispensing nozzle in accordance with the present disclosure.

FIGS. 12 and 13 illustrate other example nozzle embodiments 146. The nozzle 146 shown in FIG. 12 dispenses fluid directly out of an end surface 147 at an angle of $\Theta_6$ relative to a horizontal plane X. The angle $\Theta_6$ may be the same as an angle $\Theta_5$ at which the nozzle 146 is arranged relative to the horizontal plane X. In some embodiments, the nozzle 146 is integral with a dispensing pipe 32. In some embodiments, the nozzle 146 has a reduced opening size at the end of 147 to increase pressure as the fluid is dispensed.

FIG. 13 shows the nozzle 146 being adjustable through different angles $\Theta_5$ using an adjustment feature 148. The adjustment feature 148 may include a motor controlled joint that adjusts the angle $\Theta_5$. The adjustment feature 148 may adjust the position of nozzle 146 through various planes, using for example, a ball and socket connection that provides pivoting through multiple planes. The adjustment feature 148 may be controlled at least in part using control system 28. The orientation of nozzle 146 may be adjusted based on, for example, a monitored condition using monitoring devices 24.

Figure 14:
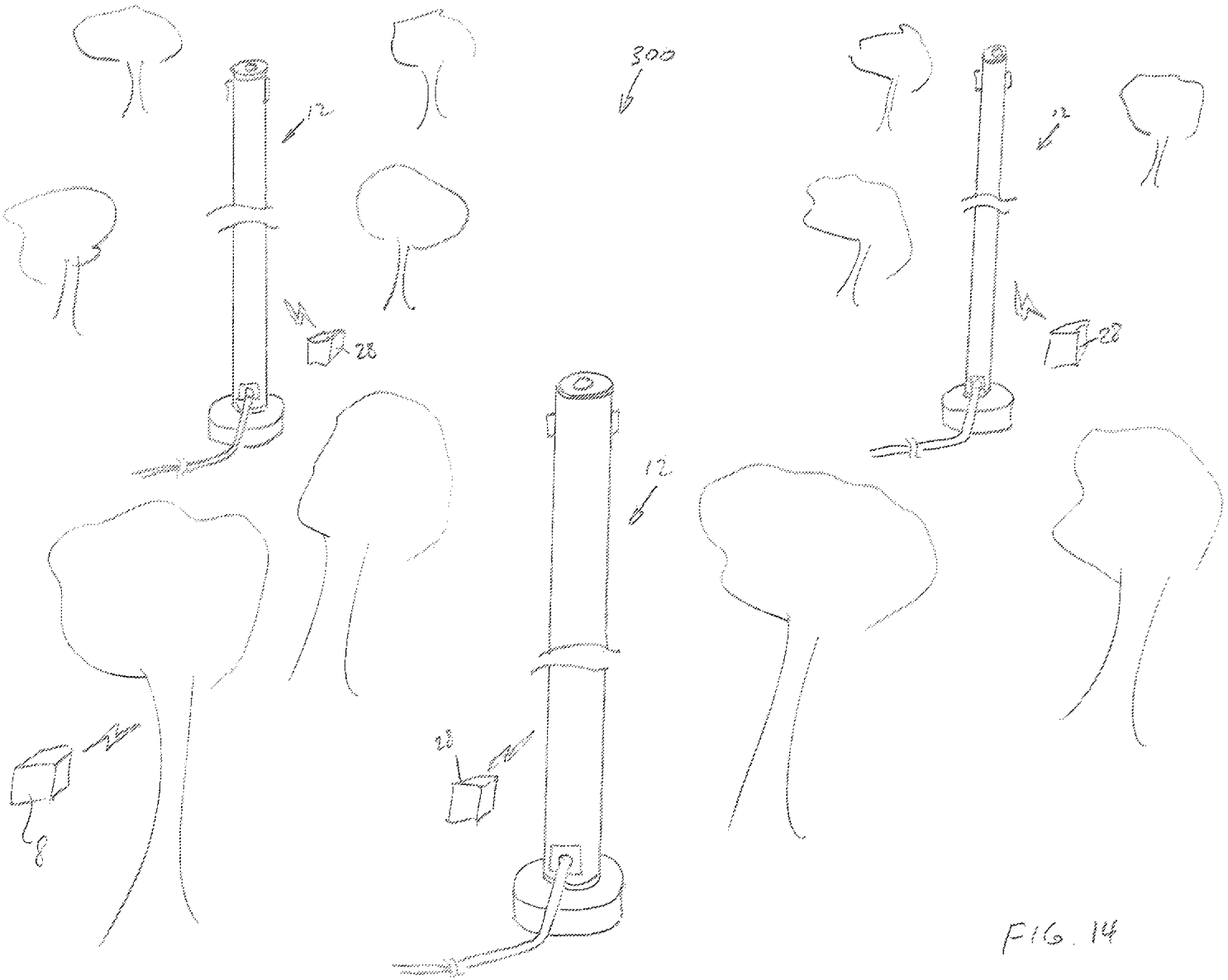
FIG. 14 is a perspective view of another fire suppressant delivery system in a forest environment in accordance with the present disclosure.

FIG. 14 shows an example of fire suppression delivery system 300 that includes a plurality of delivery apparatuses 12. The delivery apparatuses 12 may be positioned spaced apart from each other within a predetermined area, such as within a forest, within or surrounding agricultural land, or within a neighborhood adjacent to a forest or undeveloped area. The delivery apparatuses 12 may be individually controlled to dispense fluid in the area surrounding the delivery apparatus 12. The fire suppression delivery system 300 may include a central control center 8 that provides cooperative control of fluid dispensing among all of the delivery apparatuses 12 to provide dispensing of fluid at certain times and to certain areas, either automatically or based on controls provided from a remote location. In some embodiments, the control systems 28 associated with each of the delivery apparatuses 12 may be in communication with each other and/or in communication with a central control center 8. The control systems 28 may use various networks for electronic communication including, for example, satellite communication, cellular communication, local area network communication, and/or the Internet. The control systems 28 and other electronic features of the delivery apparatuses 12 may be battery controlled to provide improved mobility and independent operation of the delivery apparatuses 12 or components thereof.

The delivery apparatuses 12 within the fire suppressant delivery system 300 may have different sizes, different shapes, and capabilities to provide customized functionality for a given application. For example, some of the delivery apparatuses 12 may be configured to dispense a certain fluid at a particular height and/or with a certain droplet size, while other of the delivery apparatuses 12 may be configure to dispense other fluids at other heights and/or droplet sizes.

In the embodiment of FIG. 14, the area where the delivery apparatuses 12 is located is a forest that is susceptible to wild fire. The fire suppressant delivery system 300 provides the ability to deliver fluids (e.g., fire suppressant) in the forest either automatically in response to fire conditions sensed by one or more of the delivery apparatuses 12, or remotely based on any available means of detecting fire conditions in the forest. In one embodiment, all of the monitoring devices 24 of the delivery apparatuses 12 transmit live stream of video recording to control systems 28 and or central control center 8. An operator of the system 300 can choose to activate the specific delivery apparatuses 12 located within the proximity of the fire. The operator can also choose the desirable dispensing angles, dispensing pressures, etc. utilizing the dispensing mechanisms 22, regulators 26, and control systems 28.

In another embodiment, the system 300 automatically activates the delivery apparatuses 12 after the monitoring devices 24 detect fire, smoke or other fire conditions. In this embodiment, the monitoring devices 24 and/or control systems 28 transmit instruction signals to the dispensing mechanisms 22 and/or regulators 26 of the delivery apparatuses 12 located in the area of interest. In addition to detecting the location of the fire, the monitoring devices 24 may also collect data relating to the magnitude, speed, temperature, and other properties of the fire. The collected data may be transmitted to the control systems 28 and/or the central control center 8 for analysis and determination of appropriate fluid dispensing settings for each of the activated dispensing mechanisms 22.

In one application, when the fire is still on early stage, only one apparatus is needed to be activated to put out the fire. In this case, the system 300 may select only the delivery apparatus 12 that is located nearest to the fire and active the associated dispensing mechanism 22. In another application, when the fire is located between two delivery apparatuses 12, both delivery apparatuses 12 must be activated, but with only some of the nozzles 46 of each dispensing mechanism 22 are activated. The ability to control the dispensing angle and pressure based on a detected location and particular characteristics of the fire may be helpful for optimizing delivery of fire suppressant and addressing fire conditions.

In another application, the nozzles are set with a high dispensing pressure which supply large volume of fire suppressant in a short period of time. This setting is preferred to stop fire that is already grown into a large size. In one application, the nozzles are configured to dispense a fog-like mist by delivering less volume at a lower pressure, this application is preferred in other settings such as to help stop the spreading of fire into new areas. A fog or mist of fire suppressant may limit the oxygen that is available to the fire.

The fluids used for dispensing by the fire suppressant delivery systems disclosed herein may include, for example, liquids, gels, foams, gases, and the like. The dispensing mechanisms used for dispensing the fluid may be customized for a particular type of fluid being delivered. In some examples, a given dispensing mechanism may include a plurality of different nozzles for dispensing various types of fluids. In some embodiments, a given fire suppressant delivery system may include delivery apparatuses that are optimized for a given type of fluid such that a variety of different fluids can be dispensed within a given area where the fire suppressant delivery system is in use.

It thus can be seen that he embodiments described above may provide many advantages such as, without limitation:

- A fluid delivery system, particularly for delivery of fire suppressant, that automatically adjusts an angle of dispensing the fluid based on real-time detection of fire conditions to provide more efficient and effective delivery of the fluids.
- A fluid delivery system, particularly for delivery of fire suppressant, that automatically adjusts the number of dispensing nozzles and/or a direction of dispensing of fluid from one or more nozzles in response to real-time detection of fire conditions to provide more efficient and effective delivery of the fluids.
- A fluid delivery system that is operable to deliver fluids, particularly fire suppressants, without human interaction with the delivery apparatuses, thereby limiting the risk of injury to humans as part of fighting fires.
- A fluid delivery system that is operable to delivery fluids, particularly fire suppressants, at different pressures, volume flow rates, and the like to provide different droplet sizes for the dispensed fluids, which provides options for fighting fires and preventing spreading of fires depending the fire conditions.

A fluid delivery system that is operable to deliver fluids, particularly fire suppressants, at variable heights by adjusting a height of a dispensing tower of the fluid delivery system, thereby providing for dispensing a vertical positions at or above surrounding foliage, building structures, etc., or to optimize the spread of the fluid depending on monitored fire or environmental conditions.

A fluid delivery system that is operable to delivery fluids from a plurality of stand-alone delivery apparatuses, wherein the fluid delivery system optimizes delivery of fluid to an area of interest from one or more of the delivery apparatuses based on monitored fire conditions.

While certain embodiments and details have been included herein for purpose of illustrating aspects of the instant disclosure, it will be apparent to those skilled in the art that various changes in systems, apparatus, and methods disclosed herein may be made without departing from the scope of the instant disclosure.

Changes may be made in the function and arrangement of elements discussed without departing from the spirit of the disclosure. Various embodiments may omit, substitute, or add various procedures or components as appropriate. For instance, the methods described may be performed in an order different from that described, and various steps may be added, omitted, or combined. Also, features described with respect to certain embodiment may be combined in other embodiments.

The invention claimed is:

1. A method of dispensing fire suppressant comprising:

positioning at least one fire suppressant delivery apparatus in an area, the at least one fire suppressant delivery apparatus comprising:

a tower member with a base permanently mounted to a ground surface of the area;

at least four nozzles mounted to the tower member, each nozzle having a fixed dispense angle radially about the tower member between about 45° and about 90°, each nozzle oriented to dispense a fire suppressant away from the tower member in a different direction than the other nozzles;

a flow controller operable to control flow of a fire suppressant separately to each of the nozzles; and at least one fire monitoring device mounted to the tower member;

monitoring the area for fire with the at least one fire monitoring device;

detecting fire with the at least one fire monitoring device;

automatically supplying fire suppressant with the flow controller selectively to one or more of the nozzles in response to the detected fire, wherein the flow controller supplies fire suppressant only to one or more of the nozzles oriented in the direction of the detected fire; and selectively dispensing the fire suppressant from the one or more of the nozzles oriented in the direction of the detected fire.

2. The method of claim 1, wherein the flow controller is operable to control at least one of a dispensing pressure and a dispensing volume separately to each of the nozzles.

3. The method of claim 2, wherein each of the plurality of nozzles dispenses fire suppressant to about 90° of a circumference of the tower member.

4. The method of claim 2, wherein the plurality of nozzles comprises four nozzles, and each of the four nozzles dispenses fire suppressant to about 90° of a circumference of the tower member.

5. The method of claim 1, wherein the tower member comprises a plurality of inner supports and at least one dispensing pipe supported by the inner supports and in fluid communication with the nozzles.

6. The method of claim 1, wherein the tower member includes a plurality of dispensing pipes each in fluid communication with different ones of the nozzles.

7. The method of claim 6, wherein the flow controller is operable to control at least one of a dispensing pressure and a dispensing volume of fire suppressant separately to each of the dispensing pipes.

8. A method of dispensing fire suppressant comprising:

positioning at least one fire suppressant delivery apparatus in an area, the at least one fire suppressant delivery apparatus comprising:

a tower member with a base permanently mounted to a ground surface of the area;

at least four nozzles mounted to the tower member, each nozzle having a fixed dispense angle radially about the tower member between about 45° and about 90°, each nozzle oriented to dispense a fire suppressant away from the tower member in a different direction than the other nozzles;

a flow controller operable to control flow of a fire suppressant separately to each of the nozzles; and at least one fire monitoring device mounted to the tower member;

monitoring the area for fire with the at least one fire monitoring device;

detecting fire with the at least one fire monitoring device;

automatically supplying fire suppressant with the flow controller selectively to one or more of the nozzles in response to the detected fire, wherein the flow controller supplies fire suppressant only to one or more of the nozzles oriented in the direction of the detected fire;

selectively dispensing the fire suppressant from the one or more of the nozzles oriented in the direction of the detected fire; and adjusting at least one of a dispensing pressure and a dispensing volume based on the monitoring.

9. The method of claim 8, wherein the flow controller is operable to control at least one of a dispensing pressure and a dispensing volume separately to each of the nozzles.

10. The method of claim 9, wherein each of the plurality of nozzles dispenses fire suppressant to about 90° of a circumference of the tower member.

11. The method of claim 9, wherein the plurality of nozzles comprises four nozzles, and each of the four nozzles dispenses fire suppressant to about 90° of a circumference of the tower member.

12. The method of claim 8, wherein the tower member comprises a plurality of inner supports and at least one dispensing pipe supported by the inner supports and in fluid communication with the nozzles.

13. The method of claim 8, wherein the tower member includes a plurality of dispensing pipes each in fluid communication with different ones of the nozzles.

14. The method of claim 13, wherein the flow controller is operable to control at least one of a dispensing pressure and a dispensing volume of fire suppressant separately to each of the dispensing pipes.

* * * * *